US011161223B2

(12) United States Patent
Chen

(10) Patent No.: US 11,161,223 B2
(45) Date of Patent: Nov. 2, 2021

(54) SOCKET POSITIONING DEVICE OF RATCHET WRENCH

(71) Applicant: Yi-Fu Chen, Taichung (TW)

(72) Inventor: Yi-Fu Chen, Taichung (TW)

(73) Assignee: Ping-Chun Chen, Taichung (TW)

( * ) Notice: Subject to any disclaimer, the term of this patent is extended or adjusted under 35 U.S.C. 154(b) by 204 days.

(21) Appl. No.: 16/675,237

(22) Filed: Nov. 6, 2019

(65) Prior Publication Data

US 2021/0129298 A1 May 6, 2021

(51) Int. Cl.
*B25B 13/46* (2006.01)
*B25B 13/06* (2006.01)

(52) U.S. Cl.
CPC ..... *B25B 13/463* (2013.01); *B25B 13/06* (2013.01)

(58) Field of Classification Search
CPC ..... B25B 13/463; B25B 13/462; B25B 13/06; B25B 23/0007; B25B 23/0035
USPC ..... 81/60
See application file for complete search history.

(56) References Cited

U.S. PATENT DOCUMENTS

2015/0298304 A1* 10/2015 Chen ..... B25B 23/0035 81/125
2016/0199966 A1* 7/2016 Wang ..... B25B 23/0057 81/63.1

* cited by examiner

*Primary Examiner* — Joseph J Hail
*Assistant Examiner* — Caleb Andrew Holizna

(57) ABSTRACT

A ratchet wrench includes a ratchet unit which has a ratchet tube with a reception hole. A collar is connected to one side of the head and has a slit defined radially through the collar. An engaging member has a first end thereof fixed to the collar, and a second end of the engaging member extends through the slit. The second end of the engaging member is partially located within the through hole of the collar and located above the reception hole of the ratchet tube. An operation ring is mounted to the collar and connected the engaging. A C-clip is mounted to the outer periphery of the collar. When the operation ring is rotated, the second end of the engaging member is pushed to move within the through hole of the collar to position a socket located in the reception hole of the ratchet tube.

5 Claims, 8 Drawing Sheets

SOCKET POSITIONING DEVICE OF RATCHET WRENCH

BACKGROUND OF THE INVENTION

1. Fields of the Invention

The present invention relates to a ratchet wrench, and more particularly, to a socket positioning device of a ratchet wrench.

2. Descriptions of Related Art

The conventional ratchet wrench known to applicant is disclosed in Taiwanese Patent No. 1540023 and includes a handle and a driving section which includes a tool seat on one side of the driving section. The tool seat includes a through hole, and a slot and an opening are defined radially in one end of the tool seat. The slot and the opening communicate with the through hole. A clip is connected to the end of the tool seat with the slot and the opening, and the clip has an engaging section and an operation section which is connected to the engaging section. The engaging section is inserted into the opening and warps along the periphery of the tool seat. The operation section extends through the slot. The operation section is operated to deform the engaging section to position the socket connected to the wrench.

However, the clip has to be made by harder material so as to resiliently position the socket, such that the users have to operate the operation section with a significant force. This may not be suitable for some users and even hunt the users' fingers. A positioning ring is used for the users to switch, but the positioning ring has to be bent so as to be properly installed to the wrench. The bending decreases the structural strength of the positioning ring. Besides, the positioning ring is perpendicular to the operation section and frequently operated to apply a force to the operation section in the same direction, so that the force eventually deforms the operation section and the clip may not be able to position the socket as expected. The clip may also be broken due to being frequent pushed.

The present invention is intended to provide a socket positioning device of a ratchet wrench so as to eliminate the drawbacks mentioned above.

SUMMARY OF THE INVENTION

The present invention relates to a ratchet wrench and comprises a handle and a head which has an installation hole defined axially therethrough, and a recess is defined in the inner periphery of the installation hole so as to receive a ratchet unit therein. The ratchet unit includes a ratchet tube which has a reception hole defined axially therethrough. A collar is connected to one side of the head has a through hole defined axially therethrough which communicates with the reception hole of the ratchet tube. A slit is defined radially through the collar and communicates with the through hole. An engaging member has a first end thereof fixed to the collar, and a second end of the engaging member extends through the slit. The second end of the engaging member is partially located within the through hole of the collar via the slit, and located above the reception hole of the ratchet tube. An operation ring is mounted to the collar and has a path defined in the underside thereof. The second end of the engaging member is partially received in the path. A C-clip is mounted to the outer periphery of the collar. The collar has a connection portion. The C-clip is connected to the connection portion and contacts the operation ring. When the operation ring is rotated, the second end of the engaging member is pushed to move within the through hole of the collar to removably position a socket located in the reception hole of the ratchet tube.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
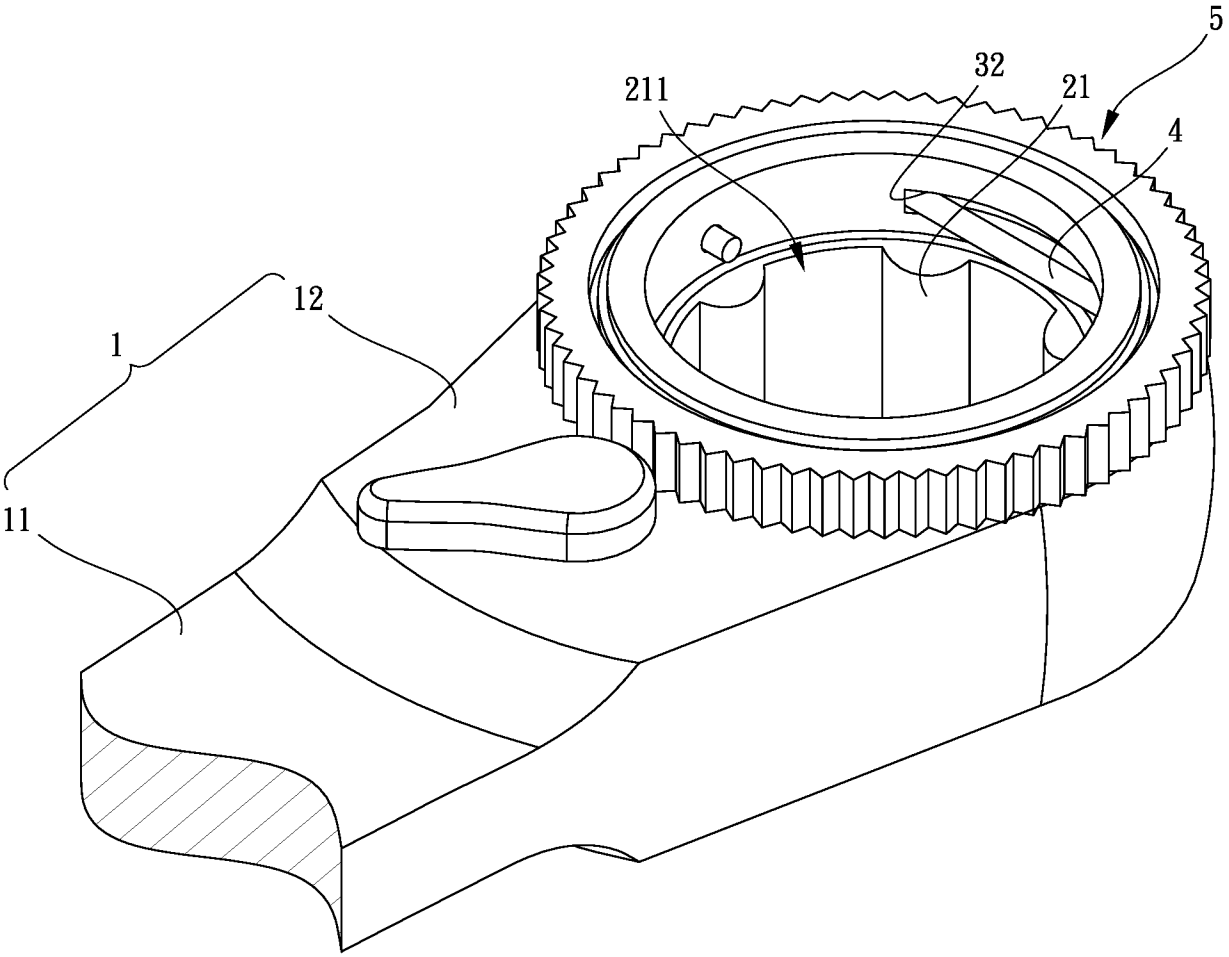
FIG. 1 is a perspective view to show the ratchet wrench with the socket positioning device of the present invention.
Figure 2:
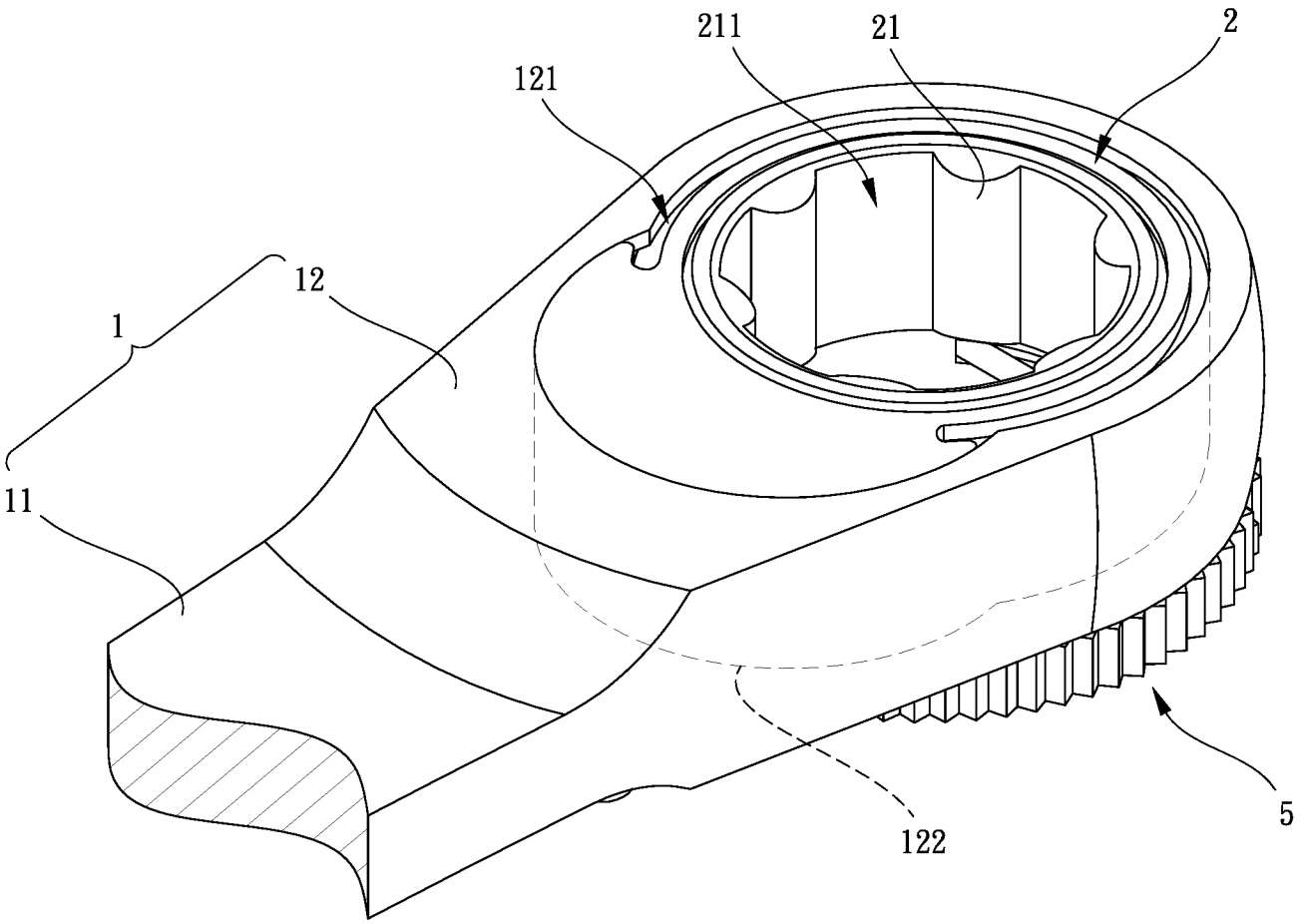
FIG. 2 is another perspective view to show the ratchet wrench the socket positioning device of the present invention.

Referring to FIGS. 1 to 8, the ratchet wrench 1 of the present invention comprises a handle 11 and a head 12 which is formed to one end of the handle 11, and a socket 10 to be connected to the head 12. The socket 10 includes a groove 101 defined in the outer periphery thereof, and a mounting hole 102 is defined axial in the socket 10.

The head 12 has an installation hole 121 defined axially therethrough, and a recess 122 is defined in the inner periphery of the installation hole 121. A ratchet unit 2 is received in the recess 122 and includes a ratchet tube 21 which has a reception hole 211 defined axially therethrough. A collar 3 is connected to one side of the head 12 and encloses the installation hole 121. The collar 3 has a through hole 31 defined axially therethrough which communicates with the reception hole 211 of the ratchet tube 21. A slit 32 is defined radially through the collar 3 and communicates with the through hole 31. The collar 3 has a connection portion 33 which is formed by a flange 35 extending radially and outward from one side of the collar 3. Of course, the collar 3 can also be integral with the head 12.

Figure 6:
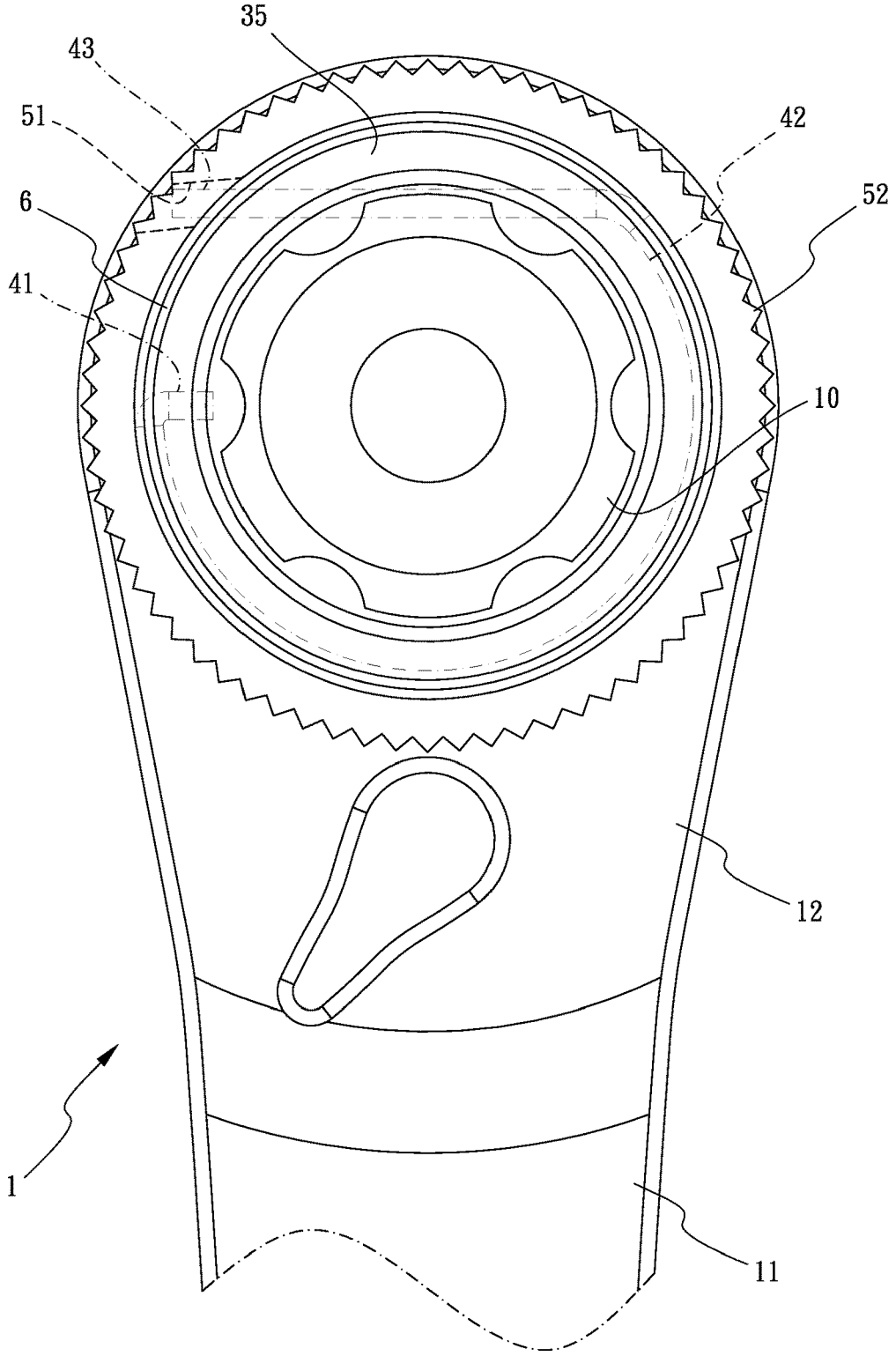
FIG. 6 is a top view of the ratchet wrench disclosed in FIG. 4.

An engaging member 4 is a C-shaped member and includes a fixed end 41, a curved portion 42 and an operation portion 43. The fixed end 41 is formed to the first end of the engaging member 4, and the operation portion 43 is formed to the second end of the engaging member 4. The curved portion 42 is formed between the fixed end 41 and the operation portion 43. The fixed 41 is inserted into an aperture 34 of the collar 3, and the curved portion 42 extends along the outer periphery of the collar 3. The operation portion 43 extends through the slit 32 and has its distal end extending beyond the slit 32 of the collar 3. As shown in FIG. 6, the operation portion 43 of the engaging member 4 is partially located within the through hole 31 of the collar 3 via the slit 32, and located above the reception hole 211 of the ratchet tube 21.

Figure 3:
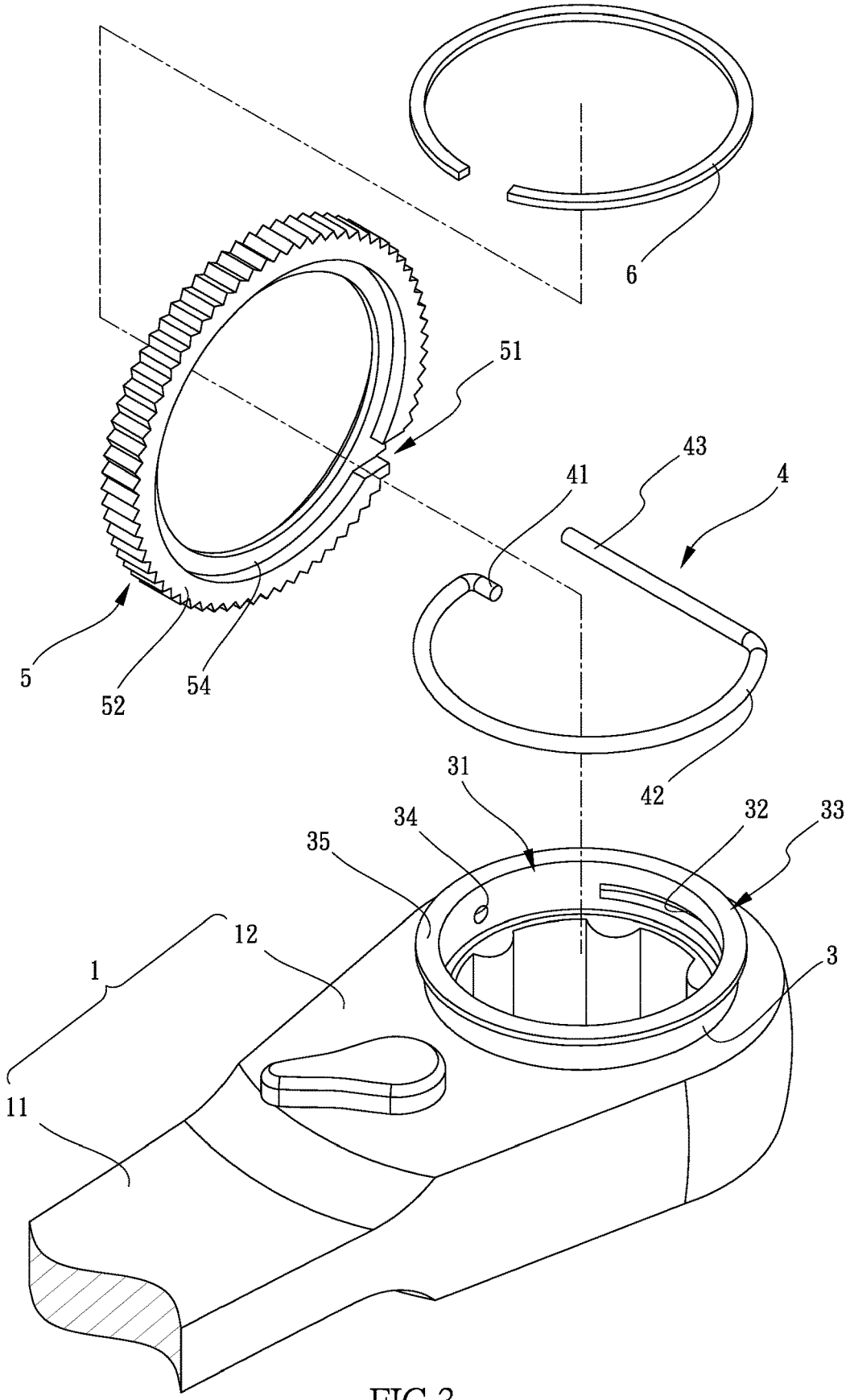
FIG. 3 is an exploded view of the socket positioning device of the present invention.
Figure 4:
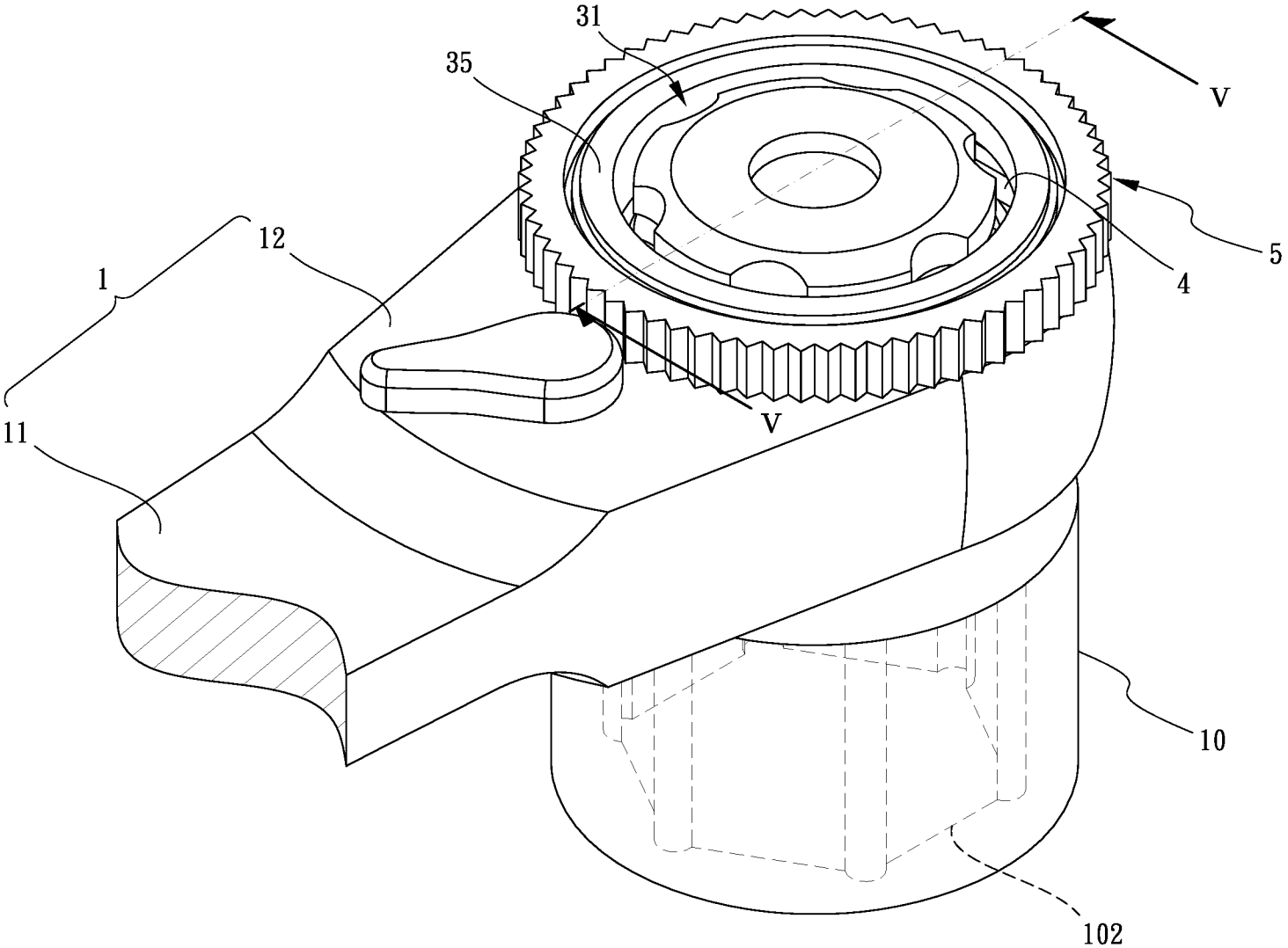
FIG. 4 is a perspective view to show that a socket is connected to the ratchet wrench with the socket positioning device of the present invention.
Figure 5:
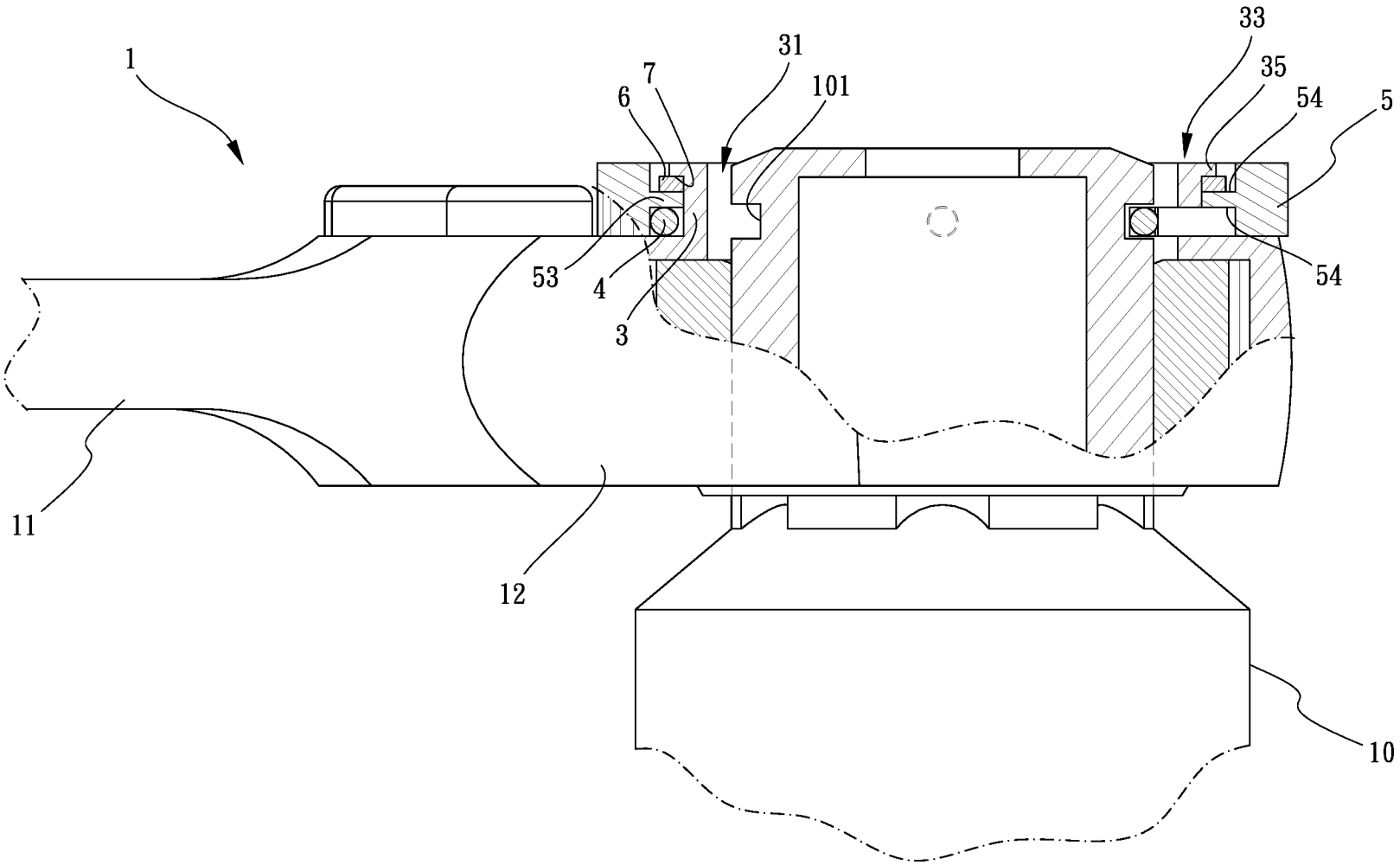
FIG. 5 is an cross sectional view, taken along line IV-IV of FIG. 4.

An operation ring 5 is mounted to the collar 3 and has a path 51 defined in the underside thereof. Specifically, the operation ring 5 includes an annular body 52 and a lip 53 which extends inward from the inner periphery of the annular body 52. A stepped portion 54 is formed between each of the two sides of the lip 53 and the annular body 52 as shown in FIG. 5. The path 51 is defined through the annular body 52 as shown in FIG. 3. When the operation ring 5 is mounted to the collar 3, the engaging member 4 is located in one of the two stepped portions 54 and covered by the lip 53, such that the engaging member 4 does not jump away from the collar 5. The distal end of the operation portion 43 of the second end of the engaging member 4 that extends beyond the slit 51 is received in the path 51. The operation ring 5 partially covers up the engaging member 4.

A C-clip 6 is mounted to the outer periphery of the collar 3 and connected to the connection portion 33 and contacts the operation ring 5. A room 7 is formed between the flange 35 and the operation ring 5. Specifically, the other one of the two stepped portions 54 of the operation ring 5 is used to accommodate the C-clip 6 which 6 is partially located in the room 7 and contacts the operation ring 5. The C-clip 6 is partially exposed beyond the room 7 so that the users can easily remove the C-clip 6 to replace or maintain the inner parts of the head 12.

When the socket 10 is connected to the ratchet wrench 1, the end with the groove 101 of the socket 10 is inserted into the reception hole 211 of the ratchet tube 21, and the operation portion 43 of engaging member 4 that is located within the reception hole 211 is engaged with the groove 101 to position the socket 10 as shown in FIG. 5.

Figure 7:
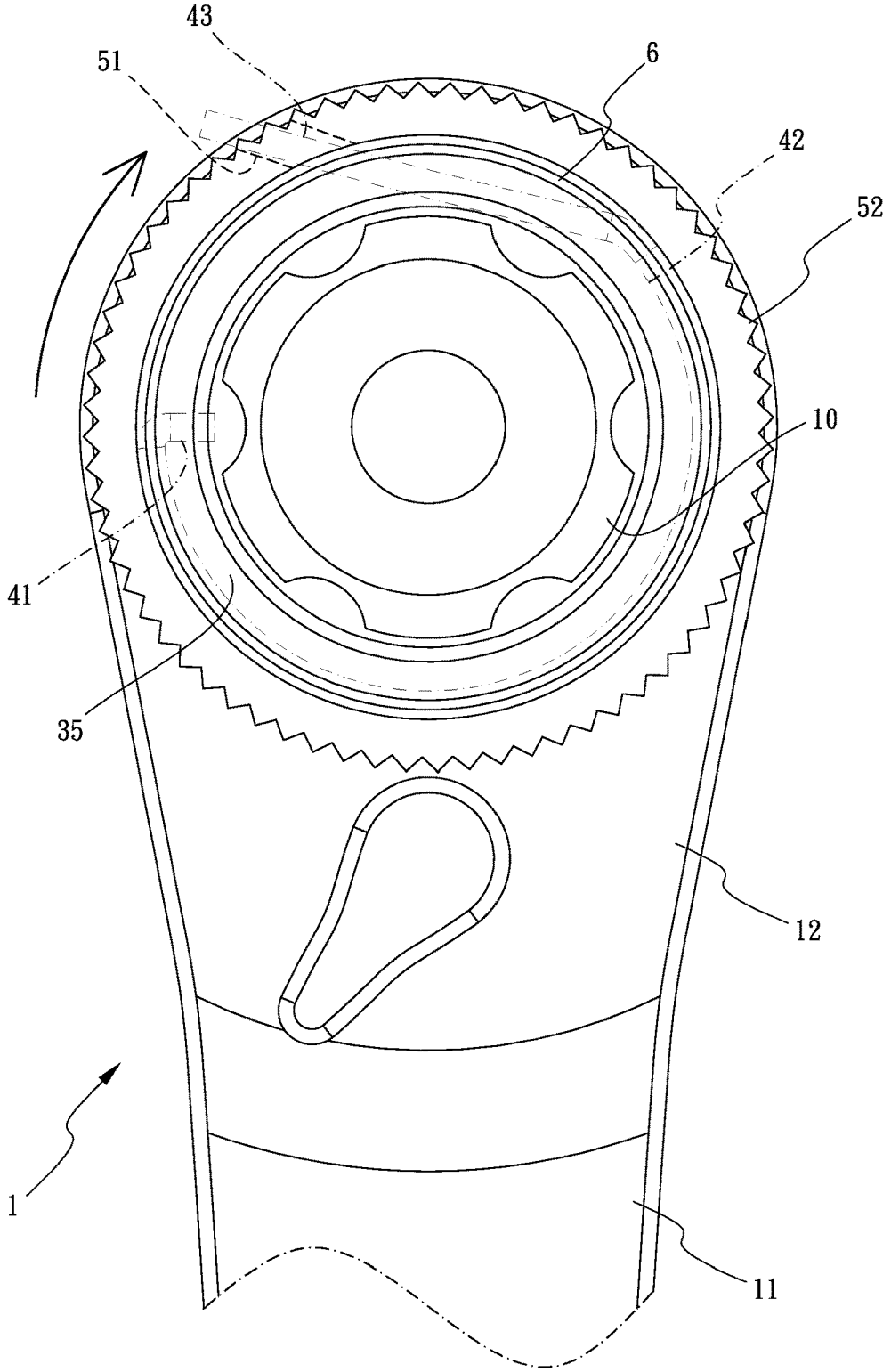
FIG. 7 is a top view to show that the operation ring is rotated, and the engaging member is disengaged from the socket.
Figure 8:
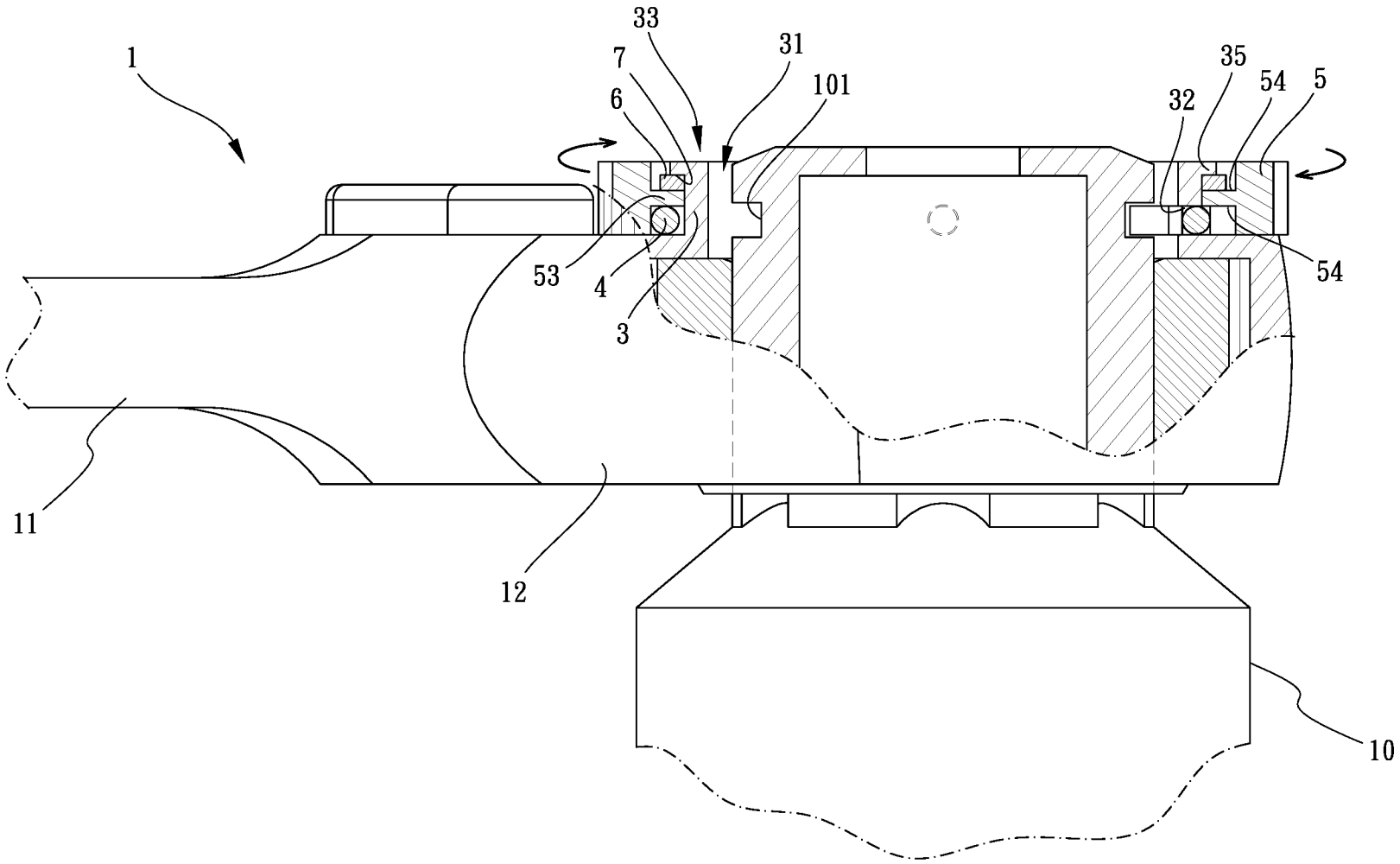
FIG. 8 is a cross sectional view to show that the operation ring is rotated, and the engaging member is engaged with the socket.

When the users want to release the socket 10, the operation ring 5 is rotated, so that the inside wall of the path 51 of the operation ring 5 directly pushes the operation portion 43 of the second end of the engaging member 4 in the through hole 31 of the collar 3 to remove the operation portion 43 from the groove 101 of the socket 10. Therefore, the socket 10 can be removed from the reception hole 211 of the ratchet tube 21 as shown in FIGS. 7 and 8.

The users simply rotate the operation ring 5 to move the operation portion 43 of the engaging member 4 to easily release the socket 10 from the ratchet wrench 1. The engaging member 4 is prevented from overly deformed when being manufactured. The drawbacks of the ratchet wrench disclosed in Taiwanese Patent No. 1540023 are overcome.

While we have shown and described the embodiment in accordance with the present invention, it should be clear to those skilled in the art that further embodiments may be made without departing from the scope of the present invention.

What is claimed is:

1. A ratchet wrench comprising a handle and a head formed to one end of the handle, the head having an installation hole defined axially therethrough, a recess defined in an inner periphery of the installation hole and a ratchet unit received in the recess, the ratchet unit including a ratchet tube which has a reception hole defined axially therethrough;

a collar connected to one side of the head and enclosing the installation hole, the collar having a through hole defined axially therethrough which communicates with the reception hole of the ratchet tube, a slit defined radially through the collar and communicating with the through hole;

an engaging member having a first end thereof fixed to the collar, a second end of the engaging member extending through the slit and a distal end of the second end of the engaging member extending beyond the slit, the second end of the engaging member partially located within the through hole of the collar via the slit, and located above the reception hole of the ratchet tube;

an operation ring mounted to the collar and including an annular body, a lip extending inward from an inner periphery of the annular body, a stepped portion formed between each of the two sides of the lip and the annular bode, a path defined in an underside of the operation ring, the path defined through the annular body, the distal end of the second end of the engaging member received in the path, the operation ring partially covering up the engaging member, and a C-clip mounted to the outer periphery of the collar, the collar having an connection portion, the C-clip connected to the connection portion and contacting the operation ring, when the operation ring is rotated, the second end of the engaging member is pushed to move within the through hole of the collar to adapted to removably position a socket located in the reception hole of the ratchet tube.

2. The ratchet wrench as claimed in claim 1, wherein the engaging member, includes a fixed end, a curved portion and an operation portion, the fixed end is formed to the first end of the engaging member, the operation portion is formed to the second end of the engaging member, the curved portion formed between the fixed end and the operation portion, the fixed is inserted into au aperture of the collar, the operation portion extends through the slit and extends beyond the collar, the curved portion extends along the outer periphery of the collar.

3. The ratchet wrench as claimed in claim 1, wherein the connection portion of the collar is formed by a flange extending radially and outward from one side of the collar, a room is formed between the flange and the operation ring, the C-clip is partially located in the room and contacts the operation ring, the C-clip is partially exposed beyond the room.

4. A ratchet wrench comprising:

a handle and a head formed to one end of the handle, the head having an installation hole defined axially therethrough, a recess defined in an inner periphery of the installation hole and a ratchet unit received in the recess, the ratchet unit including a ratchet tube which has a reception hole defined axially therethrough;

a collar connected to one side of the head and enclosing the installation hole, the collar having a through hole defined axially therethrough which communicates with the reception hole of the ratchet tube, a slit defined radially through the collar and communicating with the through hole;

an engaging member having a first end thereof fixed to the collar, a second end of the engaging member extending through the slit and a distal end of the second end of the engaging member extending beyond the slit, the second end of the engaging member partially located within the through hole of the collar via the slit, and located above the reception hole of the ratchet tube;

an operation ring mounted to the collar and having a path defined in an underside thereof, the distal end of the second end of the engaging member received in the path, the operation ring partially covering up the engaging member, and a C-clip mounted to the outer periphery of the collar, the collar having an connection portion, the connection portion of the collar formed by a flange extending radially and outward from one side of the collar, the C-clip connected to the connection portion, a room formed between the flange and the operation ring, the C-clip partially located in the room and contacting the operation ring, the C-clip partially exposed beyond the room, when the operation ring is rotated, the second end of the engaging member is pushed to move within the through hole of the collar to adapted to removably position a socket located in the reception hole of the ratchet tube.

5. The ratchet wrench as claimed in claim 4, wherein the collar is integral with the head.

* * * * *